US008007425B2

(12) United States Patent
Scheu

(10) Patent No.: US 8,007,425 B2
(45) Date of Patent: Aug. 30, 2011

(54) SUCTION ROLLER FOR TRANSPORTING FLAT MATERIAL BLANKS

(75) Inventor: Stephan Scheu, Neuwied (DE)

(73) Assignee: Winkler + Dünnebier Aktiengesellschaft, Neuwied (DE)

( * ) Notice: Subject to any disclaimer, the term of this patent is extended or adjusted under 35 U.S.C. 154(b) by 890 days.

(21) Appl. No.: 12/009,996

(22) Filed: Jan. 23, 2008

(65) Prior Publication Data

US 2008/0176728 A1 Jul. 24, 2008

(30) Foreign Application Priority Data

Jan. 24, 2007 (DE) ..... 10 2007 003 592

(51) Int. Cl.
*G03G 19/00* (2006.01)
*B26D 7/06* (2006.01)

(52) U.S. Cl. ..... 492/8; 162/368

(58) Field of Classification Search ..... 162/363–374; 492/8; 83/100
See application file for complete search history.

(56) References Cited

U.S. PATENT DOCUMENTS

| | | | | | |
|---|---|---|---|---|---|
| 2,991,218 | A | * | 7/1961 | Cirrito et al. | 162/217 |
| 3,082,683 | A | * | 3/1963 | Justus | 100/335 |
| 3,141,817 | A | * | 7/1964 | Collins et al. | 162/372 |
| 3,172,321 | A | * | 3/1965 | Schrader | 83/100 |
| 3,821,076 | A | * | 6/1974 | Stenberg | 162/301 |
| 4,366,025 | A | * | 12/1982 | Gordon et al. | 162/358.1 |
| 4,559,106 | A | * | 12/1985 | Skytta et al. | 162/358.3 |
| 4,602,977 | A | | 7/1986 | Voltmer et al. | |
| 4,647,333 | A | | 3/1987 | Voltmer et al. | |
| 4,693,784 | A | * | 9/1987 | Aula et al. | 162/202 |
| 4,866,826 | A | * | 9/1989 | Koide | 29/895.3 |
| 4,868,958 | A | * | 9/1989 | Suzuki et al. | 28/104 |
| 5,342,277 | A | * | 8/1994 | Steiner et al. | 492/56 |
| 5,782,156 | A | * | 7/1998 | Collins | 83/331 |
| 6,026,725 | A | * | 2/2000 | Okonski | 83/698.21 |
| 6,205,899 | B1 | * | 3/2001 | Blumle et al. | 83/98 |
| 6,634,269 | B2 | * | 10/2003 | Eckstein et al. | 83/100 |
| 6,884,323 | B2 | * | 4/2005 | Beck et al. | 162/372 |
| 2002/0092399 | A1 | * | 7/2002 | Fuchs | 83/698.21 |
| 2002/0129687 | A1 | | 9/2002 | Eckstein et al. | |
| 2004/0198577 | A1 | | 10/2004 | Blumle | |
| 2006/0248723 | A1 | * | 11/2006 | Gustafson | 29/895.32 |

FOREIGN PATENT DOCUMENTS

| | | |
|---|---|---|
| DE | 21 09 237 | 9/1972 |
| DE | 36 17 006 | 11/1987 |
| DE | 41 16 510 | 12/1991 |
| DE | 44 05 541 | 3/1995 |
| DE | 198 15 794 | 10/1998 |

(Continued)

*Primary Examiner* — David Bryant
*Assistant Examiner* — Jacob Cigna
(74) *Attorney, Agent, or Firm* — Collard & Roe, P.C.

(57) ABSTRACT

A suction roller for transporting flat material blanks has a roller axis and a mantle surface. The suction roller is independent of format and therefore can be universally used for transporting flat material blanks, particularly label blanks. The suction roller has controllable suction holes or suction zones that lie at the closest possible distance from one another on its mantle surface. To this end, the suction roller has a plurality of suction slits, which run parallel to the roller axis and open into the mantle surface, whereby at least adjacent suction slits can have suction air applied to them independent of one another, and whereby a slit cover provided with passage holes is disposed on the mantle surface, in such a manner that the passage holes align with the suction slits, at least in part.

11 Claims, 6 Drawing Sheets

FOREIGN PATENT DOCUMENTS

| | | |
|---|---|---|
| DE | 198 41 834 | 3/2000 |
| DE | 103 00 234 | 7/2004 |
| EP | 0 281 064 | 9/1988 |
| EP | 0 990 588 | 4/2000 |
| EP | 1 245 355 | 10/2002 |

* cited by examiner

SUCTION ROLLER FOR TRANSPORTING FLAT MATERIAL BLANKS

CROSS REFERENCE TO RELATED APPLICATIONS

This application claims priority under 35 U.S.C. §119 of German Patent Application No. 10 2007 003 592.8 filed on Jan. 24, 2007.

BACKGROUND OF THE INVENTION

1. Field of the Invention

The present invention relates to a suction roller for transporting flat material blanks, particularly such a suction roller for use in connection with a slit cover provided with passage holes. The suction roller according to the invention can particularly be used as a so-called blank separation roller in a label production machine. Applications in envelope production machines are also possible. Specifically, the suction roller can be used in window cutting stations, where window cutouts to be disposed of as waste must be separated from the envelope blanks that are to be processed further.

2. The Prior Art

It is known from DE 103 00 234 B3, in connection with label production, among other things, to use a suction roller as a blank separation roller. In this connection, rows of blanks (rows of label blanks) that run with an offset in the axial direction of the suction roller, in different tangential directions of the suction roller, are dispensed by the suction roller for further transport, in order to separate the rows of blanks, which usually engage into one another in nested manner for the purpose of minimizing scrap, from one another. For this purpose, the suction roller has a plurality of suction air bores, which are connected with suction channels that run axially in the suction roller. The suction air control ensures that adjacent rows of blanks are held against the mantle surface of the suction roller over angle stretches having different lengths.

An example of a specific embodiment of the suction channel system in the suction roller is known from DE 198 41 834 A1. FIGS. 3 and 4 of DE 198 41 834 A1 show suction channels that run in the axial direction. The suction channels stand in connection with suction air bores that open into the mantle surface of the suction roller.

Furthermore, so-called tube rollers having radial suction air bores are known, which stand in a suction connection with segment-shaped suction chambers configured in the interior of the tube roller, in order to produce the desired suction effect on the mantle surface.

In the case of label production, in particular, the case occurs, as a function of the production order, in each instance, that labels having a plurality of different geometries are to be produced. In order to constantly guarantee the desired separation of blanks, the suction raster image formed by the total of the suction air bores must therefore be changed as a function of the most varied geometries, i.e. formats of the label blanks.

With these known suction rollers, the raster distance between adjacent suction air bores, to which suction air can be applied independent of one another, lies on the order of magnitude of approximately 7 mm. This order of magnitude is not sufficient, in practice, to make controllable suction air bores available that lie so close to one another that the same suction roller can always be used as a blank separation roller, independent of the label format. Therefore, the production of different suction rollers as a function of format is necessary.

This requirement leads to undesirable effort and expenditure in terms of costs, material, and storage.

SUMMARY OF THE INVENTION

It is therefore an object of the present invention to provide a suction roller that is independent of format and therefore can be universally used, for transporting flat material blanks, particularly label blanks, which roller has controllable suction holes or suction zones on its mantle surface, lying at the smallest possible distance from one another.

These and other objects are achieved according to the invention by a suction roller for transporting flat material blanks and a suction roller for use in connection with a slit cover provided with passage holes. The suction roller includes a roller axis and a mantle surface and has a plurality of suction slits which run parallel to the roller axis and open into the mantle surface. At least adjacent suction slits can have suction air applied to them independent of one another. The slit cover can be or is disposed on the mantle surface in such a manner that the passage holes align at least partially with the suction slits. Further embodiments of the invention are evident from the discussion below.

According to the invention, the suction roller is provided with a plurality of suction slits that run essentially in the radial direction, as well as parallel to the axis. In this connection, the width of the suction slits, measured in the circumferential direction of the suction roller, can be kept relatively slight. Furthermore, the suction slits can be disposed at a relatively slight distance from one another in the circumferential direction.

At this point, it should be noted that not only suction air can be drawn in through the suction slits of the suction roller according to the invention, but also compressed air can be blown out in order to support the release of the flat material pieces from the suction roller in targeted manner. The term "suction" used in the present application to describe characteristics according to the invention should therefore also be understood as making reference to "pressure."

The suction slits that open into the mantle surface can be covered, according to the invention, using a slit cover disposed on the mantle surface in releasable or non-releasable manner. The slit cover covers the suction slits in such a way that a suction air connection between the suction slits and the surroundings becomes possible only by the passage holes provided in the slit cover, which holes align at least partially with the suction slits. Because at least suction slits that are adjacent to one another in the circumferential direction can have suction air applied to them independent of one another, a fine raster of suction holes, i.e. rows of suction holes that can have suction air applied to them independent of one another is created, which allows the transport of flat material blanks having the most varied formats. With regard to the distribution, in terms of area, of suction holes or rows of suction holes that can be controlled independent of another, the triggering is refined, as compared with the state of the art, in such a manner that any desired formats can be transported using the suction roller according to the invention, and corresponding rows of blanks can be separated. In particular, among other things, an advantage that is particularly important in the case of relatively small flat material pieces is achieved, namely that the flat material pieces having various formats can always be held directly at their front edge, without having to replace the suction roller or having to make other changes on it. In this connection, it should be pointed out that the suction slits are preferably disposed so as to be uniformly spaced and distributed over the entire circumference of the suction roller according to the invention.

In the case of a change in format, suction holes at whose position no suction effect is desired, as a function of the format, can be closed off by simply being glued shut. If the slit cover provided with the passage holes is disposed so as to be releasable from the mantle surface, slit covers for formats that are to be produced more frequently may be kept on hand. Such slit covers have passage holes only at certain locations as a function of the format. In the case of the formats in question, it will then not be necessary to glue shut any holes, which is an advantage, whereby the advantage that no format-dependent complete suction roller has to be produced continues to be maintained.

Preferably, each suction slit has suction air applied to it through an axial channel, which is disposed in one of the faces of the suction roller and opens into the suction slit, in each instance. It is particularly advantageous to dispose those axial channels that are assigned to two or more adjacent suction slits at different radial distances from the roller axis, i.e. at different radial depths, proceeding from the mantle surface. In this manner, there is the possibility of selecting the suction cross-section of the axial channels to be relatively great, despite the smallest possible distance of the suction slits from one another, according to the invention, for example as great as it has already been selected in the case of the suction rollers known from the state of the art. In this way, spatial interpenetration of the different axial channels having a great suction cross-section is avoided, according to the invention. At the same time, it is guaranteed, in advantageous manner, that the suction volume required for producing the desired suction effect can be drawn in.

Preferably, a plurality of groups of axial channels is formed. Each group includes at least two, three, four or more axial channels, in each instance, which are assigned to two, three, four or more suctions slits that are adjacent in the circumference direction, i.e. follow one another, and lie on the circumferences of circles having two, three, four or more different diameters.

The axial channels are preferably configured as bores. Therefore, the axial channels preferably have a circular cross-section. The diameter of the circle is preferably at least as great as the sum of twice the width of the suction slits, measured in the circumferential direction, and the width of the mantle surface region remaining between two adjacent suction slits, also measured in the circumferential direction. Even more preferably, the diameter of the circular cross-section of the axial channels is at least as great as the sum of twice the width of the suction slits and twice the width of the mantle surface region of the suction roller remaining between two adjacent suction slits.

BRIEF DESCRIPTION OF PREFERRED EMBODIMENTS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Turning now in detail to the drawings, the embodiment shown is a suction roller 12 that functions as a blank separation roller in a label production machine. Suction roller 12 according to the invention can also be used within the framework of other application cases, in which the transport of flat material blanks having any desired formats is required.

Figure 1:
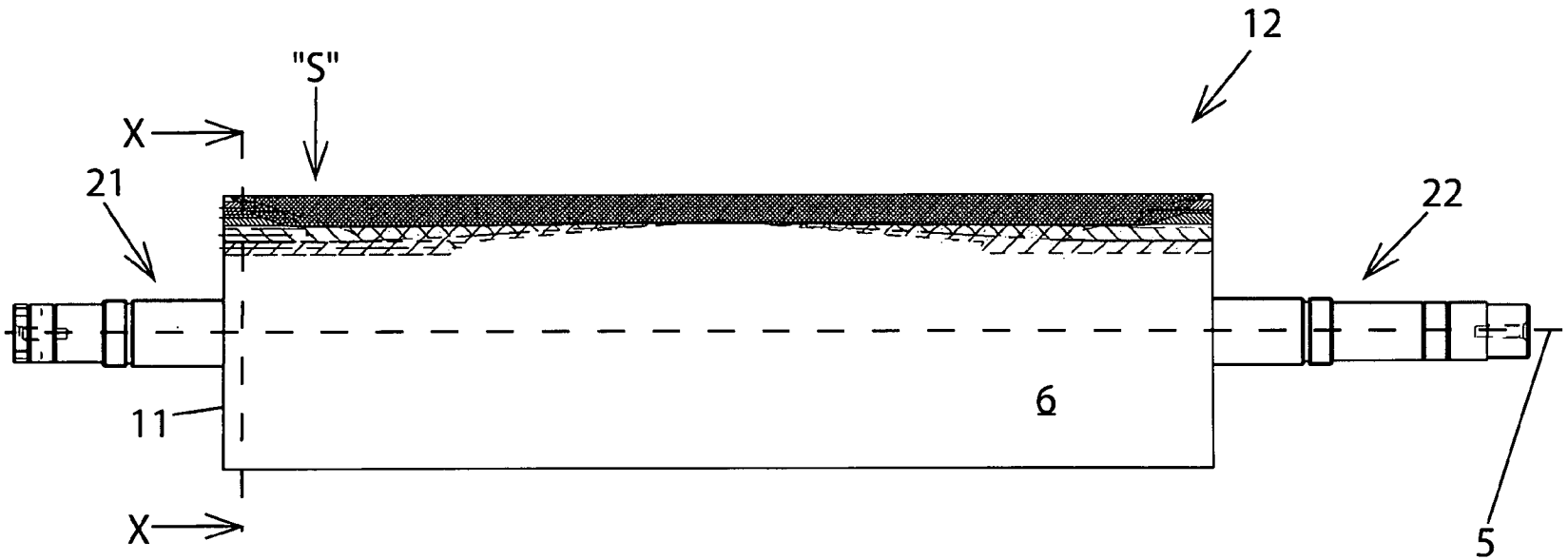
FIG. 1 is a side view of an embodiment of the suction roller according to the invention, with suction slits shown as examples, as well as without a slit cover.

FIG. 1 shows the complete suction roller 12 in a side view. It is mounted in suitable bearings, in known manner, with its two shaft stumps 21, 22, and rotates about its roller axis 5 during operation of the label production machine. Suction slits are indicated in FIG. 1 with different cross-hatchings, and will be described in greater detail below.

Figure 2:
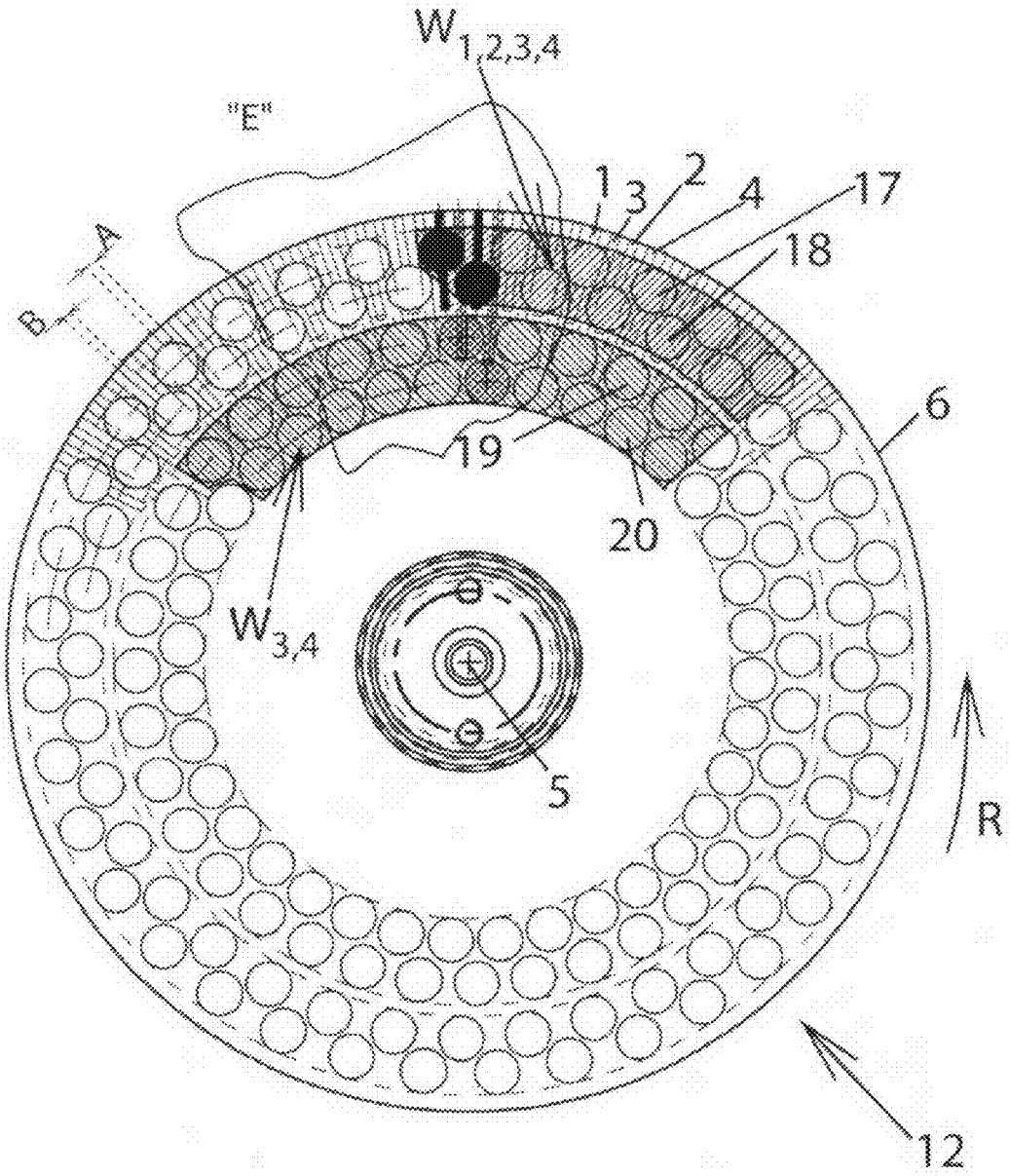
FIG. 2 is a sectional view according to the section X-X in FIG. 1.
Figure 3:
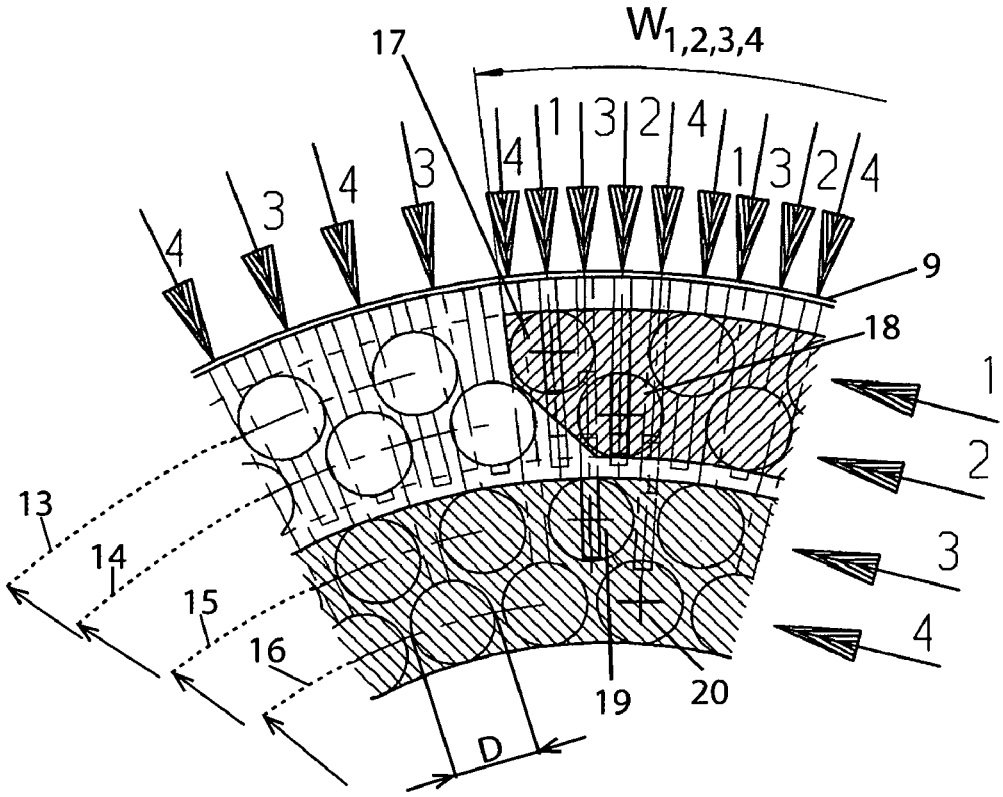
FIG. 3 is an enlarged representation of the detail "E" from FIG. 2, but with a slit cover.

FIG. 2 shows a sectional view according to section X-X in FIG. 1. A plurality of suction slits is shown, whereby the four suction slits 1, 3, 2, 4 are characterized with reference symbols, as examples. Suction slits 1, 3, 2, 4 form a group of suction slits. Corresponding groups of suction slits 1, 3, 2, 4 are also shown in FIG. 3, which shows detail "E" from FIG. 2 on a larger scale. In the four different radial section views of FIG. 5, the suction slits 1, 3, 2, 4 of a group are also shown.

A plurality of groups comprising the suctions slits 1, 3, 2, 4 is disposed around the entire circumference of suction roller 12. All the suction slits that are present have the same width B, measured in the circumferential direction of suction roller 12, and they are spaced uniformly apart from one another over the entire circumference. However, in the drawings, particularly in FIG. 2, only a part of the suctions slits that are present, in total, is shown.

In FIG. 1, it can be seen that all the suction slits extend essentially over the entire axial length of suction roller 12. This arrangement is not compulsory, but it is advantageous. However, the suction slits extend at least over that axial length of suction roller 12 that forms the transport region, i.e. the transport width of suction roller 12, with regard to the rows of blanks to be transported axially next to one another.

Figure 5:
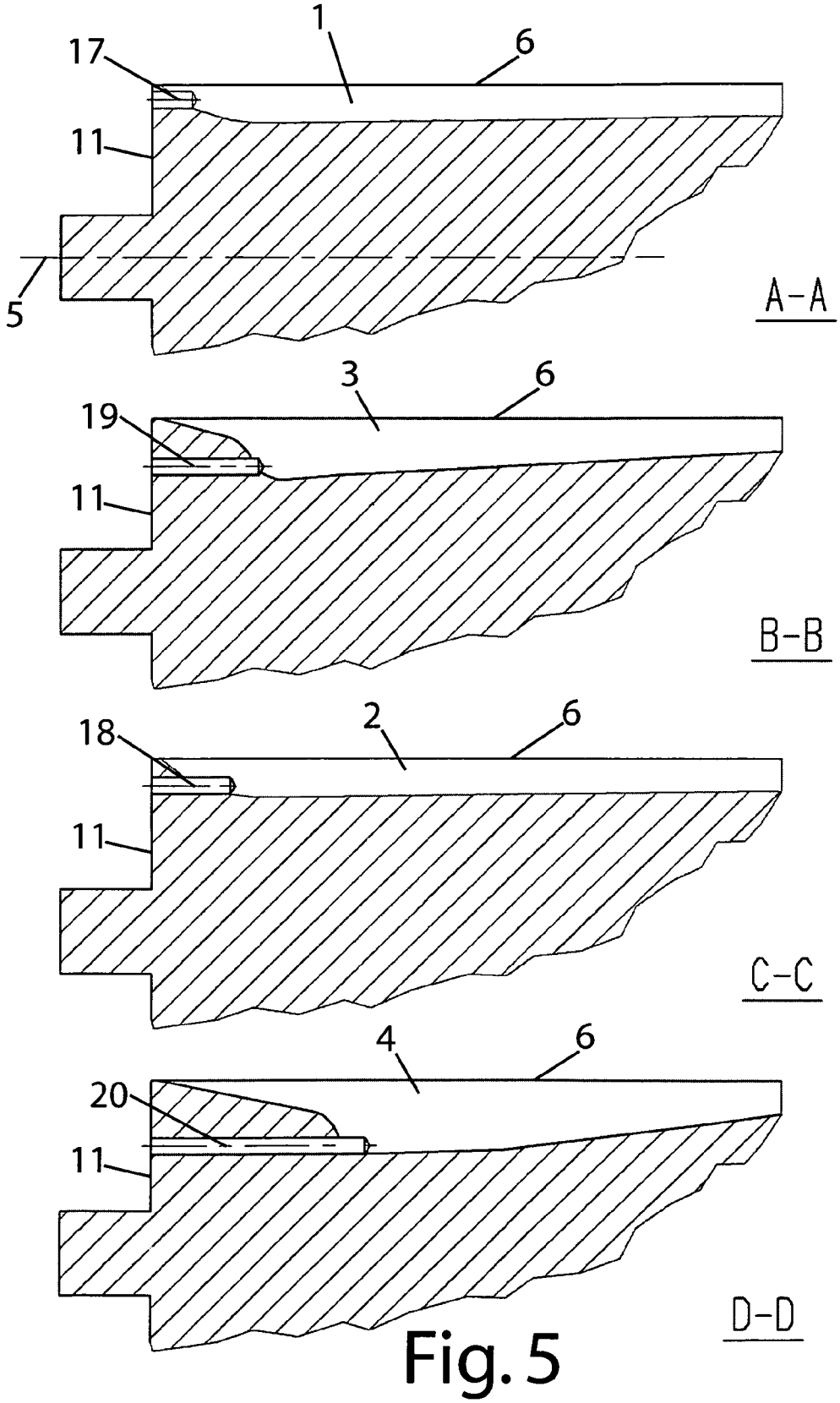
FIG. 5 shows various sectional representations through the suction slit according to the sections A-A, B-B, C-C, and D-D in FIG. 4, but without a slit cover, in each instance.

All the suction slits are preferably made in suction roller 12 using a side and face milling cutter. FIGS. 2 and 5 show that the suction slits open into mantle surface 6 of suction roller 12. Thus, there is a flow connection with the surroundings. If one looks at mantle surface 6 in the radial direction, each suction slit stands in a flow connection with the surroundings by way of a cross-sectional area that corresponds to an elongated, very narrow rectangle having the short rectangle side B.

Furthermore, a plurality of axial channels having a circular cross-section is shown in FIGS. 2, 3, and 5, of which one group comprising the four axial channels 17, 18, 19, 20 is characterized with reference numbers, as an example. All the axial channels were drilled into the face 11 of the suction roller 12 that is on the left in FIG. 1. Preferably, corresponding axial channels are also disposed in the region of the right face in FIG. 1.

In the following, the interactions will be explained using the example of the group of suction slits 1, 3, 2, 4 and the axial channels 17, 19, 18, 20, respectively. The same holds true analogously also with regard to all the other groups of suction slits and axial channels that are present circumferentially around the entire suction roller 12.

As shown in FIGS. 2 and 3, axial channels 17, 18, 19, 20 lie with their center points on circle circumferences 13, 14, 15, 16 having different diameters. Axial channel 17 lies on circle circumference 13 having the largest diameter, axial channel 18 lies on the circle circumference 14 having the second-largest diameter, axial channel 19 lies on the circle circumference 15 having the third-largest diameter, and axial channel 20 lies on circle circumference 16 having the smallest diameter. Furthermore, as can be seen in FIG. 5, in particular, axial channel 17 stands in a flow connection with suction slit 1, axial channel 18 stands in a flow connection with suction slit 2, axial channel 19 stands in a flow connection with suction slit 3, and axial channel 20 stands in a flow connection with suction slit 4. Thus, suction slits 1, 3, 2, 4 have suction air applied to them via axial channels 17, 19, 18, 20 that lie at different radial depths.

As can be seen in FIGS. 2 and 3, in particular, the disposition of axial channels 17, 18, 19, 20 at different depths allows moving suction slits 1, 2, 3, 4 closely together in the circumference direction of suction roller 12. Such close spacing of suction slits 1, 2, 3, 4 would not be possible while keeping the axial cross-sectional surface of axial channels 17, 18, 19, the same, if the axial channels were disposed on a circle circumference having the same diameter. According to the invention, the particular advantage is achieved that while the size of the suction force (the cross-section of the axial channels) is maintained, a more refined suction raster is formed on mantle surface 6 of suction roller 12.

In the case of the embodiment shown, axial channels 17, 18, 19, 20 preferably all have the same diameter D. This diameter D is preferably at least as great as the sum of twice the width B of the suction slits, shown in FIG. 2, and the distance A between adjacent suction slits, also shown in FIG. 2. In this connection, the distance A is not to be understood as the distance to be measured between the center planes of two adjacent suction slits, but rather as the distance that two walls of adjacent suction slits, which walls face one another, have from one another, i.e. as the width of the mantle surface region of mantle surface 6 remaining between two adjacent suction slits. A diameter D that is at least as great as the sum of twice the width B of the suction slits and twice the distance A between two adjacent suction slits is particularly preferred.

The width B of suction slits 1, 2, 3, 4 can amount to 1.6 mm, for example, and the distance A can be selected in the order of magnitude of approximately 1.8 mm, for example. The raster distance from center to center of two adjacent suction slits 1, 3 or 3, 2 or 2, 4, respectively, to which suction air can be applied independent of one another, then turns out to be A+B=3.4 mm. This raster distance is approximately half of the raster distance on the order of magnitude of 7 mm that is found in the case of conventional suction rollers, so that the raster precision can be at least doubled with the suction roller 12 according to the invention.

According to the invention, it is alternatively possible to distribute the axial channels on more or fewer than four circle circumferences having different diameter, as a function of their cross-sectional size. Within the framework of the present invention, it would even be possible to dispose the axial channels on only a single circle circumference, if it is possible to produce axial channels having such cross-section geometries that allow such an arrangement, on the one hand, and a sufficiently large suction cross-sectional area, on the other hand, in terms of production technology.

In FIG. 5, it can be seen that suction slits 1, 3, 2, 4 have differently great radial depths at their ends that are on the left in FIG. 1, i.e. in the region of axial channels 17, 19, 18, 20, proceeding from mantle surface 6, in order to be able to communicate with axial channels 17, 19, 18, 20 that lie at the corresponding depths. Proceeding from the end of suction slits 1, 3, 2, 4 that is on the left in FIG. 1, the radial depth of each suction slit 1, 3, 2, 4 decreases towards the center of the roller and reaches the same depth there, in every suction slit 1, 3, 2, 4. In the half of suction roller 12 that is on the right in FIG. 1, suction slits 1, 3, 2, 4 run symmetrical to their progression in the left half.

A suction air control valve, not shown in the drawings, is disposed on face 11 of suction roller 12 as well as at the face opposite face 11, which valve is known to a person skilled in the art, in terms of its fundamental type, from DE 198 41 834 A1, for example. In the case of the present invention, the suction air control valve is designed in such a manner that it applies suction air to axial channels 17, 18, on the one hand, and axial channels 19, 20, on the other hand, independent of one another. As a result, the application of suction air to the adjacent suction slits 1, 3 and 3, 2 and 2, 4, respectively, also takes place independent of one another.

The suction air control valve controls the suction air application in such a manner that axial channels 17, 18 and therefore suction slits 1, 2 have suction air applied to them as long as they are situated in a predetermined first angle region $W_{1,2,3,4}$ of suction roller 12. This angle region is fixed in space and accordingly does not rotate with suction roller 12. As a result, those axial channels 17, 18 that enter into the spatially fixed angle region $W_{1,2,3,4}$ because of the rotation of the suction roller 12 have suction air applied to them, whereas those axial channels 17, 18 that exit from the spatially fixed angle region $W_{1,2,3,4}$ because of the rotation of the suction roller 12 are switched to have no suction, and therefore no suction effect is produced in the related suction slits 1, 2 any longer. In similar manner, axial channels 19, 20 are controlled in such a manner that they have suction air applied to them as soon as they enter into a predetermined second spatially fixed angle region $W_{3,4}$, and are switched to have no suction as soon as they exit from the second spatially fixed angle region $W_{3,4}$, so that no suction effect is produced in the related suction slits 3, 4 any longer.

Parts of the first and the second spatially fixed angle region $W_{1,2,3,4}$ and $W_{3,4}$, respectively, are characterized with different cross-hatchings in FIGS. 2 and 3. In FIG. 2, suction roller 12 rotates counter-clockwise, in accordance with the arrow R. Considered in the direction of rotation R, the angle regions $W_{1,2,3,4}$ and $W_{3,4}$ begin at the same angle position. In FIG. 2, the angle regions $W_{1,2,3,4}$ and $W_{3,4}$ are not shown completely, by means of corresponding cross-hatching. Considered in the direction of rotation R, they begin at an angle position that lies farther forward, so that the axial channels 17, 18, 19, 20 enter into the angle regions $W_{1,2,3,4}$, $W_{3,4}$ sooner than is evident from FIG. 2. In the final analysis, the angle position and the angle expanse of the angle regions $W_{1,2,3,4}$, $W_{3,4}$ is selected as a function of the requirements of the specific application case.

As shown in FIG. 2, the ends of the spatially fixed angle regions $W_{1,2,3,4}$ and $W_{3,4}$ that lie in the rear in the direction of rotation R lie at different angle positions. The first angle region $W_{1,2,3,4}$ has a smaller angle expanse than the second angle region $W_{3,4}$, so that the first angle region $W_{1,2,3,4}$, considered in the direction of rotation R, ends sooner than the second angle region $W_{3,4}$, and lies completely within the second angle region $W_{3,4}$. Accordingly, the suction air control valve brings about the result that all axial channels 17, 18, 19, 20 have suction air applied to them as long as they are simultaneously situated in the first and in the second angle region $W_{1,2,3,4}$, $W_{3,4}$. Accordingly, all suction slits 1, 2, 3, 4 also have suction air applied to them in the first and second angle region $W_{1,2,3,4}$, $W_{3,4}$.

This suction distribution state is shown in the right half of FIG. 3. The arrows labeled with the reference symbols "1," "2," "3," and "4" all the way to the right in FIG. 3 indicate that axial channels 17 that lie on circle circumference 13 act on suction slits 1, in each instance; axial channels 18 that lie on circle circumference 14 act on suction slits 2, in each instance; axial channels 19 that lie on circle circumference 15 act on suction slits 3, in each instance; and axial channels 20 that lie on circle circumference 16 act on suction slits 4, in each instance.

As soon as axial channels 17, 18, 19, 20 leave the first angle region $W_{1,2,3,4}$, axial channels 17, 18 are switched to have no suction, and only the application of suction air to axial channels 19, 20 is maintained. Accordingly, only suction slits 3, 4 continue to have suction air applied to them. This suction effect state is shown in the left half of FIG. 3. This state is maintained as long as axial channels 19, 20 are situated in the second angle region $W_{3,4}$. As soon as they leave the angle region $W_{3,4}$ in the direction of rotation R, they are also switched to have no suction, so that after departure from the second angle region $W_{3,4}$, no suction effect is produced any longer in any of the suction slits 1, 2, 3, 4.

In the case of the embodiment shown, a suction effect is therefore produced in suction slits 1, 2, 3, 4 as long as they are simultaneously situated in the first and second angle region $W_{1,2,3,4}$, $W_{3,4}$, while a suction effect is produced only in suction slits 3, 4, if suction slits 1, 2, 3, 4 have left the first angle region $W_{1,2,3,4}$, but are still situated in the second angle region $W_{3,4}$.

Figure 4:
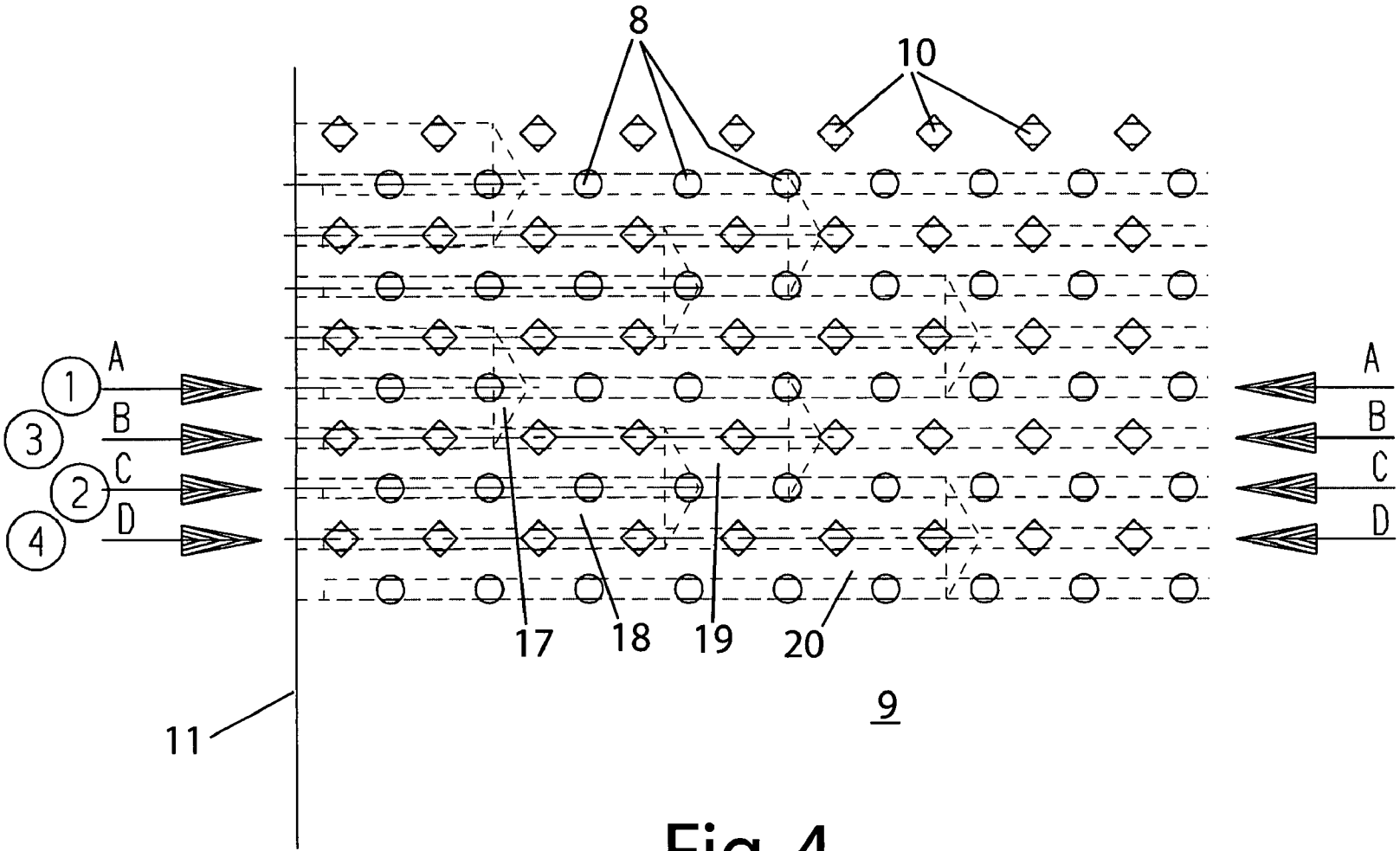
FIG. 4 is a developed view of a part of the top view "S" of the suction roller indicated in FIG. 1, but with a slit cover.

In FIG. 3, a slit cover 9 disposed on mantle surface 6 is indicated, which is preferably configured as a perforated sheet-metal mantle. In FIG. 4, the developed view of a part of this slit cover 9 is shown. It has passage holes 8 and 10, respectively. Slit cover 9 is disposed on mantle surface 6 of suction roller 12 in such a manner that passage holes 8, 10 essentially align with suction slits 1, 2, 3, 4 in the radial direction. Because of slit cover 9, there is then a flow connection between suction slits 1, 2, 3, 4 and the surroundings only through passage holes 8, 10. The production of passage holes 8, 10 in the perforated sheet-metal mantle can take place by means of laser cutting or water-jet cutting, for example.

As can be seen in FIG. 4, passage holes 8 assigned to suction slits 1, 2 have a circular hole geometry, while passage holes 10 assigned to suction slits 3, 4 have a square hole geometry. These hole geometries are merely examples, so that other hole geometries are also possible within the framework of the present invention, making it possible to optically differentiate between passage holes 8, on the one hand, and passage holes 10, on the other hand. Furthermore, it is shown in FIG. 4 that passage holes 8 are disposed offset from one another in the axial direction of suction roller 12, relative to passage holes 10. Thus, passage holes 8, 10 or 10, 8 or 8, 10, respectively, which are assigned to suction slits 1, 3 or 3, 2 or 2, 4, respectively, which are adjacent in the circumferential direction, lie at offset locations in the axial direction of suction roller 12.

To the extent that suction slits 1, 2, 3, 4 are not visible through passage holes 8, 10, they have been shown with broken lines in FIG. 4. Furthermore, axial channels 17, 18, 19, 20 configured as bores are shown with broken lines in FIG. 4. As was the case in FIG. 5, FIG. 4 also shows that axial channels 17, 18, 19, 20 penetrate into suction roller 12 with different depth in order to produce a flow connection with suction slit 1, 2, 3, 4, in each instance.

Figure 6:
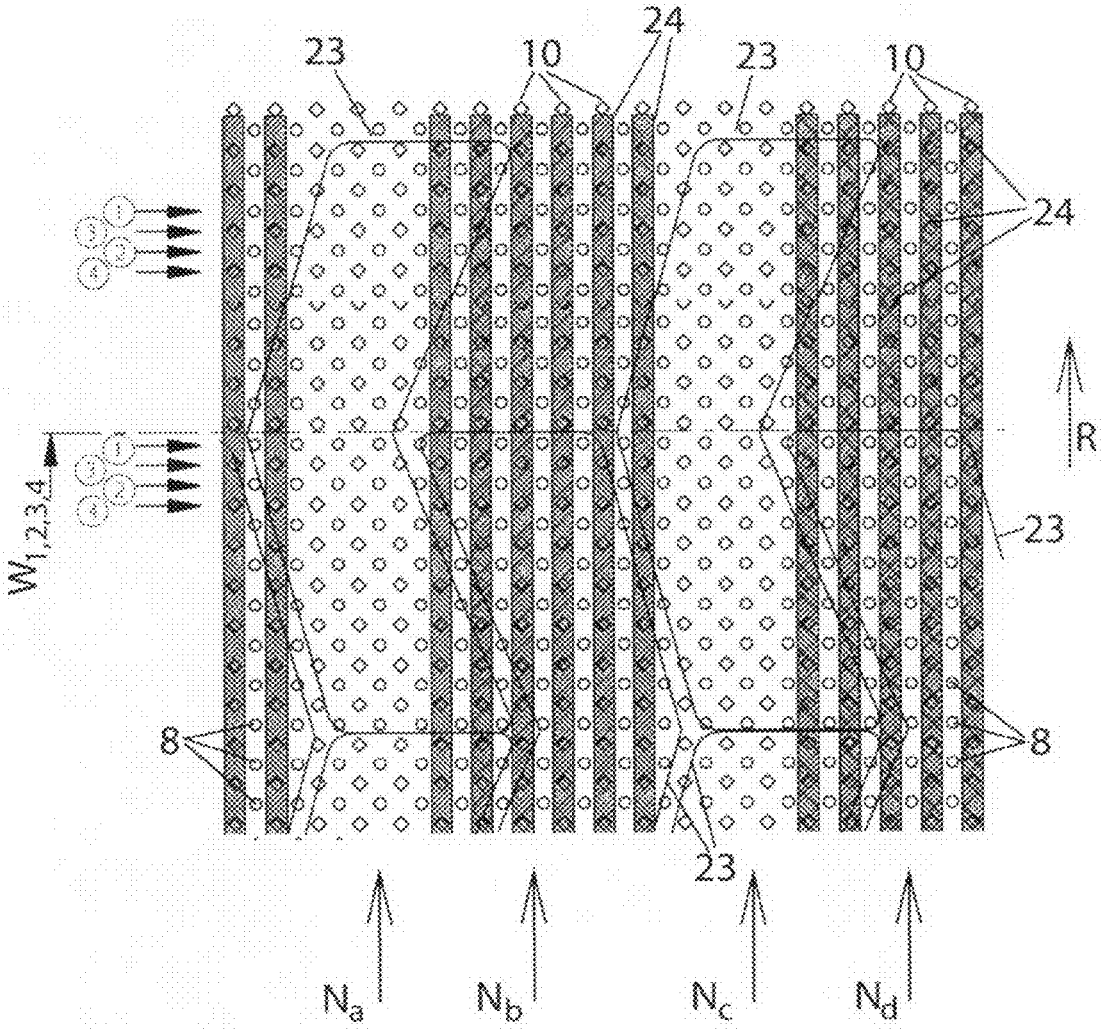
FIG. 6 is a developed view of a part of a top view of the suction roller with slit cover, rows of suction holes glued shut, and label blanks.

FIG. 6 shows the developed view of a part of slit cover 9 disposed on mantle surface 6, whereby in addition, the outlines of flat material blanks 23, in the shape of wing-shaped label blanks, seen in a top view, are shown. In particular, four rows of blanks $N_a$, $N_b$, $N_c$, and $N_d$ can be seen. The outline contours of label blanks 23 of adjacent rows of blanks $N_a$, $N_b$ or $N_b$, $N_c$, or $N_c$, $N_d$, respectively, are nested into one another in the axial direction of suction roller 12, in order to keep the paper waste that occurs during label production as low as possible. Furthermore, it is shown in FIG. 6 that rows of square passage holes 10 that essentially run in the region of the rows of blanks $N_b$ and $N_d$, in the circumferential direction, are glued shut to be air-tight, by means of adhesive strips 24. In this connection, adhesive strips 24 run around the entire circumference of suction roller 12, in each instance.

Approximately in the middle of FIG. 6, the end of the first angle region $W_{1,2,3,4}$ shown in FIGS. 2 and 3 is drawn in with a broken line. Within the first angle region $W_{1,2,3,4}$—i.e. in the lower half of FIG. 6—the label blanks 23 assigned to the rows of blanks $N_a$ and $N_c$, or parts of them, respectively, are held by that suction effect that is produced by drawing in suction air both through the open square passage holes 10 and through the open round passage holes 8. In contrast, in the angle region $W_{1,2,3,4}$, the label blanks 23 that are assigned to the rows of blanks $N_b$ and $N_d$, or parts of them, respectively, are held by the suction effect that is produced by drawing in suction air only through the open round passage holes 8, because all square passage holes 10 in the region of the rows of blanks $N_b$ and $N_d$ are glued shut to be air-tight.

If label blanks 23 move beyond the end of the first spatially fixed angle region $W_{1,2,3,4}$ in the course of the rotation of suction roller 12 in the direction of rotation R, the suction conditions change as a consequence of the suction air control that was described above, particularly in connection with FIGS. 2 and 3.

While all suction slits 1, 2, 3, 4 have suction air applied to them in the lower half of FIG. 6, the application of suction air to suction slits 1, 2 is eliminated in the upper half of FIG. 6, so that there, suction air is drawn in only through suction slits 3, 4 and thus only through square passage holes 10. The suction effect previously developed by round passage holes 8 is eliminated. Accordingly, label blanks 23 of the rows of blanks $N_b$ and $N_d$—in which the square passage holes 10 are glued shut—are no longer held against suction roller 12 by suction air when the angle region $W_{1,2,3,4}$ is left, and can be given off to a transport device that carries them further, in a first tangential direction of suction roller 12. Label blanks 23 of the rows of blanks $N_a$ and $N_c$, on the other hand, continue to be held firmly on the circumference of suction roller 12, because they are still situated in the second angle region $W_{3,4}$, in which square passage holes 10 still have suction air applied to them by way of suction slits 3, 4. As soon as label blanks 23 of the rows of blanks $N_a$ and $N_c$ reach the end of the second angle region $W_{3,4}$, which is no longer shown in FIG. 6 (see FIG. 2), in the direction of rotation R, they are also let go from suction roller 12 and can likewise be given off to a transport device that carries them further, in a second tangential direction of suction roller 12.

Control of the suction air masses and volume streams, respectively, takes place in such a manner that even at only approximately half of passage holes 8, 10 having a suction effect, a sufficient holding force is exerted on label blanks 23. In this way, it is guaranteed that label blanks 23 of the rows of blanks $N_b$ and $N_d$ are held sufficiently securely on suction roller 12 in the first angle region $W_{1,2,3,4}$, and label blanks 23 of the rows of blanks $N_a$ and $N_c$ are held sufficiently securely after they have left the first angle region $W_{1,2,3,4}$.

Because of the different hole geometries of passage holes 8, 10, the operator of the label production machine can refit suction roller 12 according to the invention to another label format, in simple manner, in that he or she merely glues shut other and/or more or fewer rows of holes of square passage holes 10 that run in the circumference direction. The refitting effort in the case of a change in format is therefore reduced to a minimum. In particular, it is not necessary, according to the invention, to replace the entire suction roller with another one.

Slit cover 9 can be attached to mantle surface 6 in non-releasable manner, for example by a weld bond, or in releasable manner. The releasable attachment can take place by magnetic force and/or positioning and holding tabs, for example, which engage into corresponding openings in slit cover 9. In the case of releasable attachment of slit cover 9, there is also the advantageous possibility of keeping slit covers 9 individually coordinated with a label format on hand for label formats that are frequently supposed to be produced, in which rows of holes that run in the circumference direction have already been glued shut or sealed to be air-tight in some other manner, as a function of the format. Refitting in the case of a change in format is then limited to an exchange of slit cover 9.

The roller body of suction roller 12 frequently consists of steel that rusts. Therefore, suction roller 12 according to the invention can be provided with a rust-protection mantle, in simple and advantageous manner, by producing slit cover 9 from a non-rusting material. Because of passage holes 8, 10, of course, no completely sealed rust protection mantle is obtained in this manner.

Although at least one embodiment of the present invention has been shown and described, it is apparent that many changes and modifications may be made thereunto without departing from the spirit and scope of the invention.

What is claimed is:

1. A suction roller for transporting flat material blanks and for use with a slit cover having passage holes, the suction roller comprising: (a) a roller axis; (b) a mantle surface; and (c) a plurality of suction slits running parallel to the roller axis and opening into the mantle surface; wherein suction air is applied to at least adjacent suction slits independently of one another; and wherein the passage holes align at least partially with the suction slits when a slit cover is disposed on the mantle surface in a selected manner; wherein each suction slit receives suction air applied via at least one respective axial channel disposed in at least one face of the suction roller and opening into the suction slit; wherein the axial channels have a circular cross-section, each axial channel having a channel diameter (D) that is at least as great as the sum of twice the suction slit width (B) of the associated suction slit measured in a circumferential direction and the width (A) of a mantle surface region remaining between two adjacent suction slits measured in the circumferential direction.

2. The suction roller according to claim 1, comprising a plurality of groups of axial channels, each group comprising at least first and second axial channels assigned respectively to first and second circumferentially-adjacent suction slits and lying on respective circle circumferences having different diameters, so that the first and second axial channels open into the respective first and second suction slits at different radial distances from the roller axis.

3. The suction roller according to claim 1, wherein the axial channels have a circular cross-section, each axial channel having a diameter (D) that is at least as great as the sum of twice the suction slit width (B) of the associated suction slits, measured in a circumferential direction and twice the width (A) of a mantle surface region remaining between two adjacent suction slits measured in the circumferential direction.

4. The suction roller according to claim 1, comprising a plurality of groups of axial channels, each group comprising at least first, second, third, and fourth axial channels assigned respectively to first, second, third, and fourth circumferentially-adjacent suction slits and lying on respective first, second, third and fourth circle circumferences having different diameters, so that the first, second, third, and fourth axial channels open into the respective first, second, third, and fourth suction slits at different radial distances from the roller axis.

5. The suction roller according to claim 4, wherein the first axial channel assigned to the first suction slit lies on the first circle circumference having the largest diameter, the second axial channel assigned to the second suction slit that follows the first suction slit in a circumferential direction lies on the second circle circumference having the third-largest diameter, the third axial channel assigned to the third suction slit that follows the second suction slit in the circumferential direction lies on the third circle circumference having the second-largest diameter, and the fourth axial channel assigned to the fourth suction slit that follows the third suction slit in the circumferential direction lies on the fourth circle circumference having the smallest diameter.

6. A suction roller assembly comprising a suction roller for transporting flat material blanks and a slit cover having passage holes, the suction roller comprising: (a) a roller axis; (b) a mantle surface; and (c) a plurality of suction slits running parallel to the roller axis and opening into the mantle surface; wherein suction air is applied to at least adjacent suction slits independently of one another; and wherein the slit cover is disposed on the mantle surface so that the passage holes align at least partially with the suction slits; wherein each suction slit receives suction air applied via at least one respective axial channel disposed in at least one face of the suction roller and opening into the suction slit; wherein the axial channels have a circular cross-section, each axial channel having a channel diameter (D) that is at least as great as the sum of twice the suction slit width (B) of the associated suction slit measured in a circumferential direction and the width (A) of a mantle surface region remaining between two adjacent suction slits measured in the circumferential direction.

7. The suction roller assembly according to claim 6, wherein the passage holes assigned to adjacent suction slits are disposed offset relative to one another, in an axial direction of the suction roller.

8. The suction roller assembly according to claim 6, wherein the passage holes assigned to adjacent suction slits differ by hole geometries that are different in a top view.

9. The suction roller assembly according to claim 6, wherein the slit cover is made of a non-rusting material.

10. The suction roller assembly according to claim 6, wherein the slit cover is releasably attached to the mantle surface.

11. The suction roller assembly according to claim 10, wherein the slit cover is attached to the mantle surface by magnetic force.

* * * * *